US005947274A

United States Patent [19]

Taskis et al.

[11] Patent Number: 5,947,274

[45] Date of Patent: Sep. 7, 1999

[54] DESICCATING CONTAINER FOR MOISTURE-SENSITIVE MATERIAL

[75] Inventors: Charles Bernard Taskis, Worthing; Simon Joseph Holland, Hove; Paul John Whatmore, Worthing, all of United Kingdom

[73] Assignee: SmithKline Beecham p.l.c., Brentford, United Kingdom

[21] Appl. No.: 08/776,807

[22] PCT Filed: Aug. 4, 1995

[86] PCT No.: PCT/EP95/03130

§ 371 Date: Feb. 20, 1997

§ 102(e) Date: Feb. 20, 1997

[87] PCT Pub. No.: WO96/04189

PCT Pub. Date: Feb. 15, 1996

[30] Foreign Application Priority Data

Aug. 5, 1994 [GB] United Kingdom ..... 9415864
Jun. 16, 1995 [GB] United Kingdom ..... 9512243

[51] Int. Cl.[6] ..... B65D 81/26; B65D 51/24; B65D 39/00

[52] U.S. Cl. ..... 206/204; 215/227; 215/247; 215/364

[58] Field of Search ..... 206/204; 215/227, 215/228, 231, 247–249, 364; 312/31.1

[56] References Cited

U.S. PATENT DOCUMENTS

| | | | |
|---|---|---|---|
| 1,509,916 | 9/1924 | Waite | 215/747 X |
| 2,160,607 | 5/1939 | Nagel | 312/31.1 X |
| 2,173,046 | 9/1939 | Smith | 312/31.1 X |
| 2,783,908 | 3/1957 | Winfield | 215/747 |
| 2,848,130 | 8/1958 | Jesnig | 215/247 X |
| 3,081,137 | 3/1963 | Kolokythas | 312/31.1 X |
| 3,254,784 | 6/1966 | Lancesseur | 215/228 X |
| 3,918,578 | 11/1975 | Cullen et al. | 206/204 |
| 4,146,277 | 3/1979 | Santoro | 312/31.1 |
| 4,350,508 | 9/1982 | Santoro et al. | 215/228 X |
| 4,485,204 | 11/1984 | Nabors . | |
| 4,547,536 | 10/1985 | Nabors . | |
| 4,834,234 | 5/1989 | Sacherer et al | 206/204 |
| 4,840,280 | 6/1989 | Schvester | 215/228 |
| 4,898,580 | 2/1990 | Crowley | 206/204 X |
| 5,018,621 | 5/1991 | O'Connell, Jr. | 206/204 |
| 5,288,560 | 2/1994 | Sudo | 215/364 X |
| 5,433,330 | 7/1995 | Yatsko et al. | 215/247 |

FOREIGN PATENT DOCUMENTS

| | | |
|---|---|---|
| 0 131 147 | 1/1985 | European Pat. Off. . |
| 0 311 324 A2 | 4/1989 | European Pat. Off. . |
| 0 454 967 A2 | 11/1991 | European Pat. Off. . |
| 0 577 276 | 1/1994 | European Pat. Off. . |
| 0 599 690 A1 | 6/1994 | European Pat. Off. . |
| 32 36 570 | 4/1984 | Germany . |
| 38 14 764 | 11/1989 | Germany . |
| 39 29 712 | 3/1991 | Germany . |
| 63-105064 | 5/1988 | Japan . |
| 01-033158 | 2/1989 | Japan . |
| 07-068125 | 3/1995 | Japan . |
| 1 408 981 | 10/1975 | United Kingdom . |
| 2 106 084 | 4/1983 | United Kingdom . |
| 2 181 440 | 4/1987 | United Kingdom . |
| WO 92/00889 | 1/1992 | WIPO . |

OTHER PUBLICATIONS

DeGf Azio et al., Lyophilization Closures for Protein Based Drugs, Journal of Parenteral Science and Technology, pp. 54–61, Mar./Apr. 1992.

Data base WPI, Week 9044, Derwnt Publications Ltd., London, GB; AN 90–331338 & JP,A,02 237 617 (Daiichi Kogyo Seiyaku), Sep. 20, 1990 (Abstract).

*Primary Examiner*—Bryon P. Gehman

*Attorney, Agent, or Firm*—Dara L. Dinner; Stephen Venetianer; Charles M. Kinzig

[57] ABSTRACT

The present invention is to a container, particularly for moisture sensitive materials, having a container body of a substantially atmospheric moisture-impermeable material and incorporating a solid element which is made at least in part of a desiccating polymer and which is in contact with the atmosphere inside the container.

43 Claims, 6 Drawing Sheets

DESICCATING CONTAINER FOR MOISTURE-SENSITIVE MATERIAL

This application is a §371 national stage entry of PCT/EP95/03130, filed Aug. 4, 1995.

FIELD OF THE INVENTION

This invention relates to containers, particularly to containers for moisture sensitive materials, particularly pharmaceutical substances.

BACKGROUND OF THE INVENTION

It is frequently necessary to store moisture sensitive materials for relatively long periods in containers. In a particular example, certain pharmaceutical substances are supplied and/or stored in small vials containing one or more unit doses of the dry substance. Such vials are normally sealed with an elastomeric closure including a closure wall across the mouth, and having a puncturable region such as a thin part of the closure wall through which a hypodermic needle may be inserted. By means of such a needle water or other suitable aqueous medium may be injected into the vial, the substance dissolved in situ, and the solution then withdrawn via the needle into a syringe for use in the short term before significant hydrolysis of the moisture sensitive material occurs. Such an elastomeric closure is often retained on the mouth opening of the vial by a thin metal circlip. Such puncturable seals enable this operation to be sterile. During storage the presence of atmospheric moisture within the container, or the ingress of atmospheric moisture, can cause decomposition of such materials Often moisture sensitive pharmaceutical substances are provided in containers together with an internal desiccant in the container, for example a small sachet of molecular sieve or silica gel. Clearly this is not practical when the substance has to be made up in situ within the container as described above, as contamination by desiccant on dissolution of the substance is likely.

It is known to compound polymeric materials with desiccants for various applications, but mostly as moisture absorbing spacers for multiple glazing panels. For example U.S. Pat. No. 4,485,204 and U.S. Pat. No. 4,547,536 disclose blends of polyester or polyester plus a butadiene polymer, plus a desiccant such as calcium oxide. EP 0599690 discloses a blend of a polymer such as styrene butadiene rubber, plus molecular sieve, plus also a fibrous material. EP 0599690 suggests the general possibility of use of such a polymer for drying of moisture sensitive pharmaceuticals, giving results for moisture absorption at 80% RH.

An example of a moisture sensitive pharmaceutical substance is clavulanic acid and its salts, such as potassium clavulanate. Potassium clavulanate is both hygroscopic and readily hydrolysed by water, so for handling and long term storage of potassium clavulanate it is necessary for the immediate environment to be kept extremely dry, e.g. 30% Relative Humidity ("RH") or less, preferably 10% RH or less, ideally as low as possible. To obtain and maintain such conditions in a container such as a vial of the type mentioned above requires quite a powerful desiccant ability.

Potassium clavulanate is a beta-lactamase inhibitor, and is often provided in a formulation in combination with a partner beta-lactam antibiotic. A partner which is often used in such formulations is amoxycillin. For injectable formulations amoxycillin is used in the form of sodium amoxycillin. In some forms sodium amoxycillin is a powerful desiccant, and when contained together with potassium clavulanate in a sealed vial such forms of sodium amoxycillin can exert a dehydrating effect which helps to preserve the potassium clavulanate. Other forms of sodium amoxycillin, such as the anhydrous crystalline form disclosed in EP 0131147 are less desiccating, and although it would be desirable to use such forms in formulations together with potassium clavulanate, the problem arises that these forms can be insufficiently desiccating to protect the potassium clavulanate from hydrolysis resulting from traces of moisture in the vial.

SUMMARY OF THE INVENTION

Figure 3:
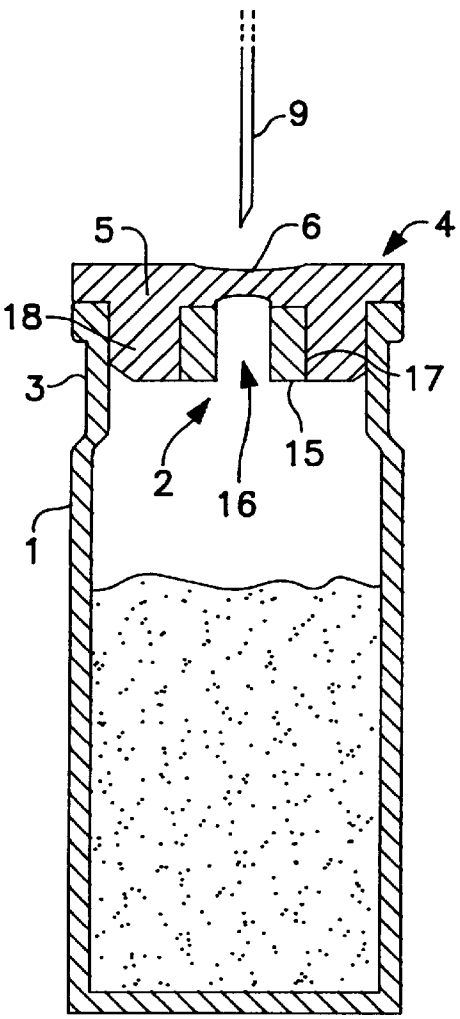
FIGS. 1, 2, and 3 show longitudinal sections through alternative multi-part construction vials and closures of the invention.

It is an object of this invention to provide a container having an internal desiccant which inter alia is suitable for use with moisture sensitive pharmaceutical substances, particularly potassium clavulanate and formulations containing potassium clavulanate, and allows sterile dissolution without the problem of contamination by desiccant. Other objects and advantages of the invention will be apparent from the following description.

DETAILED DESCRIPTION OF THE INVENTION

The present invention provides a container for a moisture sensitive material, having a container body of a substantially atmospheric moisture-impermeable material, and incorporating a solid element which is made at least in part of a desiccant polymer and which is in contact with the atmosphere inside the container.

The term "inwardly" used herein refers to directions toward the interior of the vessel unless otherwise defined.

The term "desiccant polymer" means a polymer which absorbs water from the surrounding atmosphere to the extent that it can exercise a desiccating effect upon the interior of a space within which it is contained or to the atmosphere within which it is exposed.

The desiccating polymer is suitably a polymer from which no or minimal material can be extracted by liquid water, at least during the time period the desiccant polymer is expected to be in contact with liquid water during the making up and subsequent storage of a solution in the container, e.g. during injection of water into a vial and make-up of a medicament for administration by injection.

Suitably the desiccant polymer is a biocompatible desiccant polymer.

The desiccant polymer may be an inherently desiccant polymeric material, such as a hydrophilic polymer.

Suitable biocompatible inherently desiccant polymers are the known water-absorbent hydrophilic polymers used for the manufacture of contact lenses, artificial cartilages and other bodily implants etc. Suitable such materials include hydrogel polymers, such as polymers which comprise hydroxy alkyl methacrylates, for example 2-hydroxyethyl methacrylate. Other suitable desiccant polymer include the homologous esters of the glycol monomethacrylate series such as diethylene glycol monomethacrylate and tetraethylene glycol monomethacrylate; slightly cross-linked, for example with a dimethacrylate of a glycol, copolymers of the higher glycol monomethacrylates and 2-hydroxyethyl methacrylate, acrylamide hydrogels and 2-hydroxyethyl methacrylate-vinylpyrrolidinone copolymers. Such polymers may be cross linked for example with ethylene dimethacrylate and/or 1,1,1-trimethylpropane trimethacrylate. Other suitable polymers include water-insoluble methacrylates copolymerised with 2-hydroxyethyl methacrylate. Poly (2-hydroxyethyl methacrylate) polymers can for example absorb up to 40% w:w of water. Copolymers of 2-hydroxyethyl methacrylate with a small amount of a dimethacrylate, some methyl or other alkyl methacrylate and some methacrylic acid, which can be converted to their alkali salts, can absorb at least 45% w:w of water. Copolymers of 2-hydroxyethyl methacrylate may for example also be copolymerised with n-pentyl methacrylate, vinyl propionate, vinyl acetate, isobutyl and cyclohexyl methacrylate, to produce a suitable desiccant polymer. Copolymers of 2-hyroxyethyl methacrylate with vinylpyrrolidinones, such as 1-vinyl-2-pyrrolidinone, and which may be cross linked with ethylene glycol dimethacrylate, can produce hydrogels with a higher degree of hydration, suitable as desiccant polymers. Other suitable hydrogel polymers include hydroxyethyl methacrylate N,N-dimethylacrylamide copolymers, hydroxyethyl methacrylate-N-vinyl pyrrolidone copolymers, hydroxyethyl methacrylate-acryloyl morpholine copolymers, N-vinyl pyrrolidone-methyl methacrylate copolymers, methyl methacrylate-acryloyl morpholine copolymers, hydroxyethyl methacrylate-acryloyl morpholine copolymers, methoxyethyl methacrylate-ethoxyethyl methacrylate copolymers, and methoxy methacrylate-acryloyl morpholine copolymers.

Alternatively the desiccant polymer may be a polymer material that includes a desiccant filler, for example as particles thereof dispersed in its bulk.

An example of such a desiccant polymer is an elastomeric material, such as a rubber, compounded with a desiccant material.

The compounding of the elastomeric material with a desiccant material causes the compounded material to exercise a desiccant effect upon the interior of the container. The quantity of the said elastomeric material compounded with a desiccant material should be sufficient to ensure absorption of sufficient of the water vapour in the container, or water in the moisture sensitive material contents to prevent or reduce to an acceptable degree any degradation of the material by the said water or water vapour.

The elastomeric material may be a rubber. Such a rubber may be a natural rubber, or a synthetic rubber such as a butadiene-based rubber, e.g. based on styrene-butadiene or cis-1,4-polybutadiene, butyl rubber, halobutyl rubber, ethylene-propylene rubber, neoprene, nitrile rubber, polyisoprene, silicone rubber, chlorosulphonated polyethylene or epichlorhydrin elastomer, or a mixture, blend or copolymer thereof. Halobutyl, e.g. chlorobutyl, rubbers and silicone rubbers are pharmaceutically acceptable rubbers known for use as materials for stoppers etc. to be maintained in contact with pharmaceutical products. Such elastomeric materials are sufficiently permeable to atmospheric water vapour that the desiccant material compounded with the rubber can exert its desiccant effect through a thin layer of the material.

Such rubbers may be compounded in the manner with which they are conventionally compounded for manufacture of a stopper as known in the art of manufacture of rubber stoppers. For example they may be compounded with reinforcing fillers, colouring agents, preservatives, antioxidants, additives to modify their stiffness, chemical resistance etc. such as curing/vulcanising agents. Conventional reinforcing fillers include inorganic reinforcing fillers such as zinc oxide and silicas such as china clay and other clays. Suitable compounding processes and compositions will be apparent to those skilled in the art of compounding of rubbers.

The reinforcing filler, such as china clay, normally used in the rubber may be totally or preferably partly replaced with a powdered solid desiccating material. Total replacement may lead to a loss of mechanical strength as compared to a rubber using entirely china clay as its filler, although desiccants may be found which can be used as the entire filler without loss of strength. Such a powdered desiccating material may have a particle size the same as or similar to that of the conventional inorganic fillers referred to above, so that the desiccant can serve as the filler as well. The quantity of the powdered desiccating material used may be up to the quantity in which conventional inorganic fillers are used, that is, they may completely replace the usual inorganic filler. For example the powdered desiccant may replace up to 50% of the weight of the normal weight of filler used in the rubber, e.g. 10–50%, such as 20–40%. The quantities of filler normally used in a rubber for a particular application such as a vial closure will be known to those skilled in the art.

The compounded rubber may also additionally include a conventional filler as mentioned above, for example in a quantity which together with the powdered desiccant comprises up to the weight % of filler normally included in such a rubber.

The quantity of desiccant necessary for a particular product contained in the container will depend upon the application but can easily be determined by experiment.

The desiccating material should be one which is inert relative to the elastomeric material, and vice versa. In the case of containers such as vials in which a solution is made up in situ by introduction of water or aqueous medium the desiccating material is suitably an inorganic desiccating material which is wholly or substantially insoluble in water so that none or only a pharmaceutically insignificant amount of the desiccant material or its hydration product, or undesirable ions, is likely to enter solution during the period when the desiccating polymer is in contact with water or aqueous medium. Preferred desiccants are those which can chemically or pysicochemically absorb or fix absorbed water, e.g. by formation of a hydration product, so that there is a reduced possibility of subsequent reversable release of the absorbed water, which might for example occur if the temperature of the polymer should rise, e.g to around 40° C. subsequent after earlier desiccation at a lower temperature.

Suitable inorganic desiccants are the known materials sold in the UK under the names Grace A3™, Siliporite™ and Ferben 200™. Particularly preferred desiccant materials are dried molecular sieves and calcium oxide, or mixtures thereof. Calcium oxide chemically fixes water by formation of calcium hydroxide, from which water can only be released at extreme temperatures, and absorbed water can generally only be released from molecular sieves at several hundred ° C., that is, well above the temperatures containers of pharmaceutical substances would be expected to experience under normal storage.

A preferred desiccating polymer is therefore a halobutyl, e.g. chlorobutyl, rubber compounded with an inorganic desiccant such as a molecular sieve or calcium oxide The compounded elastomeric material may be made and formed into a solid element by processes analogous to those by which solid products are made from conventional compounded elastomeric materials which include the above-mentioned inorganic fillers are made.

In one embodiment of this invention the solid element comprises a closure for the container, made wholly or partly of the said desiccating polymer. Parts of such a closure other than the parts made of desiccant polymer which are to come into contact with the atmosphere within the container may be made of generally conventional materials, preferably pharmaceutically acceptable materials, such as plastics materials, elastomeric materials etc., or composite materials such as metal and plastics or elastomeric materials. Preferably such parts are made of plastics or elastomeric materials which are of low moisture content, of low moisture permeability and low moisture affinity.

Preferably parts of the closure which engage the mouth opening are at least partly, more preferably wholly made of an elastomeric material comprising a natural or synthetic rubber (which may be the above-described desiccating rubber), thereby allowing a tight compression fit with the mouth of the vessel. The sealing engagement of the closure with the mouth opening may be by a generally conventional construction e.g. similar to a conventional stopper. For example the closure may be engaged with the rim of the neck of a vial by a screw thread, a friction/compression fitting, and/or a circlip-type clamp around the neck of the vial. Such constructions are known in the art. The closure may seal the mouth in a generally conventional manner, e.g. by a compression fitting of the closure wall against the rim of the mouth, or by a sealing ring compressed between the closure face and the rim of the mouth etc.

In one embodiment the present invention provides a container for a moisture sensitive material, having a container body of a substantially atmospheric moisture-impermeable material and having an opening sealed by a closure, characterized in that at least part of the closure which is exposed to the interior of the container body is made of a desiccant polymer, which is suitably an elastomeric material compounded with a desiccant material or a hydrophilic polymer.

In another embodiment the present invention provides a container for a moisture sensitive material, having a container body of a substantially atmospheric moisture-impermneable material and having an opening sealed by a closure, characterized in that at least part of the closure which is exposed to the interior of the container body is made of a desiccant polymer, which is suitably an elastomeric material compounded with a desiccant material or a hydrophilic polymer, the closure comprising a closure wall having a puncturable region therein in direct communication with the interior of the vessel.

Such a last-mentioned container may be a vial as mentioned above suitable for a moisture-sensitive pharmaceutical material, of generally conventional construction, the mouth opening being defined by the rim of the neck of the vial. Such a vial may be made of conventional materials such as glass, rigid plastics materials etc., but particularly glass.

By means of the invention, moisture-sensitive substances within the vessel may be protected by the desiccant material, and in this last-mentioned embodiment water may be introduced into the vessel by means of a hypodermic needle puncturing the closure face through the puncturable region, so as to dissolve the substance, and the so-formed solution of the substance may be withdrawn via the needle.

The puncturable region of the closure wall may suitably comprise a thinned region of the closure wall, and is preferably provided in a region of elastomeric material (which may comprise the desiccating polymer) which can resiliently seal around a hypodermic needle which is inserted therethrough, so as to facilitate sterile insertion and withdrawal.

Conveniently all the polymeric parts of the closure, e.g. of a vial closure and including the puncturable region, may be made of the desiccant polymer, particularly an elastomeric material compounded with a desiccant material. Such a vial closure may correspond in shape and size to conventional vial closures made of elastomeric material, and may be retained on the mouth of the vial by a conventional metal circlip. Elastomeric materials compounded with a desiccant material may be moulded into such shapes and sizes by a moulding process entirely analogous to that used to mould closures out of conventional elastomeric materials such as rubbers.

Alternatively the closure may be of multi-part construction having only parts, including those parts which are exposed to the interior of the container body, made of the said desiccant polymer.

The distribution of the desiccant polymer may be such that the desiccant polymer is located on only part of the closure wall, so that for example the puncturable region may be situated between areas of the closure wall on which is the desiccant polymer, or to one side of such an area, thereby facilitating the construction of the puncturable region as a thinned region of the closure face.

Such a multi-part construction includes the possibility that the closure may be integrally made of a co-moulded, or fused together, desiccating polymer and an elastomeric or plastics material making up parts of the structure of the closure. Alternatively the desiccating polymer may be provided as a separate part, retained by the closure on a suitable inward surface, e.g in an inwardly facing holder or cavity.

In one embodiment a multi-part construction of closure of the invention, the desiccant polymer may be in the form of a ring shape on the closure wall of a closure, with the puncturable region within, e.g. near or at the centre of, the ring. Such a ring shape may for example be circular, polygonal, or oval etc.

Such a ring-shape of desiccant polymer may be located in a corresponding ring-shaped or cylindrical holder in the closure wall. Such a holder may suitably be in the form of two generally concentric walls extending inwardly from the closure wall, the space between the walls defining the ring-shaped cavity, and the central space within the inner wall defining a central passage in direct communication with the puncturable region, down which a hypodermic needle may be inserted. Such a holder may be formed integrally with the closure wall, or may be separate part of the closure. Suitably both the walls may be integral with the closure wall, so that the closure wall forms the base of the cavity and of the central passage. Suitably in such a construction the base wall of the central passage includes the puncturable region.

Alternatively such a ring-shape of desiccant polymer may be located in a ring-shaped or cylindrical cavity in the closure wall, suitably in its inward face, the cavity opening into the interior of the container when the closure is in place on the vessel, and the central opening in the ring shape of desiccating polymer may define a central passage in direct communication with the puncturable region, down which a hypodermic needle may be inserted.

Alternatively the ring shape of desiccant polymer may be located adjacent to the inner face of the closure wall.

The desiccant polymer may be simply physically attached to the closure, e.g by cooperating parts such as projections and sockets, or simply be held in place by the inherent resilience of other parts of the closure, particularly when this is made of an elastomeric or other resilient material such as a plastics material, alternatively the desiccant polymer may be bonded to the closure e.g by adhesives or fusion together etc.

Alternatively a closure for the container, e.g. a bottle or jar of glass or plastics material, or a metal canister or keg, may be in the form of a conventional screw cap (optionally provided with tamper evident or child resistant features) or other form of closure (e.g. cam action closure, snap-fit closure) which relies on a compression fit on the lip of the mouth of the container, and having an insert made of the said desiccant polymer, e.g an elastomeric material compounded with a desiccant material, in the form of a disc or ring washer or inward facing coating layer which forms a compression seal between the lip of the mouth of the container and the closure as the container closure is tightened down, e.g. by a screw action.

Alternatively a closure for the container, e.g. a bottle or jar of glass or plastics material, or a metal canister or keg, may be a screw/interference/friction/compression fit insertable bung or other insertable stopper of its surface exposed to the interior of the container made of the said desiccant polymer, e.g an elastomeric material compounded with a desiccant material.

Alternatively the container may comprise a syringe barrel, with a plunger having at least part of its surface exposed to the interior of the container made of the said desiccant polymer, e.g an elastomeric material compounded with a desiccant material. Suitably the entire plunger may be made of the said desiccant polymer, e.g an elastomeric material compounded with a desiccant material.

Alternatively the said desiccant polymer, e.g an elastomeric material compounded with a desiccant material may be included in other forms into the container of the invention, for example as a removable resilient element such as a pad, wad, leaf, helix, coil or spiral spring which may be included in the headspace above the contents of a container and which exerts a restraining action on the contents, such a tablets, pills, capsules etc. to prevent the contents rattling about in the container. Such an element may be made as part of the container closure.

Alternatively the said desiccant polymer, e.g an elastomeric material compounded with a desiccant material may be made in the form of a pad, e.g. a flat disc to be retained at the bottom of a container, e.g. beneath tablet, pill or capsule contents.

The nature and quantity of desiccant polymer used in the container of the invention will vary with the nature of the moisture sensitive contents, and can easily be determined by straightforward experimentation or calculation, e.g. from the moisture content of the contents of the vessel. Suitably in the case of the moisture sensitive material potassium clavulanate, at the usual quantities in which it is supplied mixed with sodium amoxycillin in vials, typically of a capacity 10–20 ml, for reconstitution for an injectable formulation, e.g. 100–200 mg potassium clavulanate mixed respectively with 500–1000 mg sodium amoxycillin (expressed as the parent free acid equivalent weight) the desiccant polymer should scavenge 5–8milligrams of water with a residual RH of less than 10% throughout a two year storage period.

Preferred desiccating polymers for use with formulations containing potassium clavulanate, e.g. its coformulation with sodium amoxycillin, are able to take up atmospheric moisture at 30% RH or less, preferably at 10% RH or less. Preferred desiccating polymers excercise such a desiccant function for a long period, ideally throughout the shelf life, typically two years, of such a formulation.

Preferred desiccant polymers should also be capable of being sterilised without loss of their desiccant ability at these low RH values. For example desiccant polymer vial closures are ideally sterilised by washing prior to use, without loss of their desiccant ability. It is found that desiccant rubbers such as halobutyl, e.g. chlorobutyl, rubber compounded with calcium oxide or molecular sieves are capable of being washed without deleterious effect on their desiccant ability.

The container of the invention is particularly suitable for the containment of moisture-sensitive pharnaceutical substances such as a formulation of potassium clavulanate and sodium amoxycillin, particularly crystalline sodium amoxycillin e.g. as disclosed in EP 0131147. The invention therefore further provides a container as described above, containing a mixture which comprises potassium clavulanate and sodium amoxycillin.

Other pharmaceutical substances which may usefully be contained in the container of the invention include lyophilised substances, for example those often employed in diagnostic assy kits.

The closure of the invention, independent of the vessel, is also believed to be novel, and therefore the invention further provides a closure capable of sealing engagement with the mouth opening of a container, the closure comprising a closure wall, the inwardly facing region of the closure wall comprising or having thereon a desiccant polymer.

For example such a closure may be a closure capable of sealing engagement with the mouth opening of a container, the closure comprising a closure wall having a puncturable region therein in direct communication with the interior of the vessel, and having on an inwardly facing region of the closure wall a desiccant polymer.

Suitable and preferred forms of the closure are as described above.

The present invention also provides a method of desiccating a moisture sensitive material, which comprises enclosing the said material in a container and maintaining a desiccant polymer in contact with the atmosphere inside the container. This method may be a method of long-term storage and/or protection against hydrolysis during storage. The moisture sensitive material may be potassium clavulanate or its coformulations with sodium amoxycillin. This method is suitable for use with lyophilised, freeze dried, materials. Normally lyophilised materials are desiccated by an intense drying process before vials containing them are sealed, and this method of the invention provides the advantage that less intense drying processes may be used, and the desiccant polymer can thereafter complete the dehydration process whilst in the sealed vial.

Suitable and preferred forms of the process are as described above.

Figure 2:
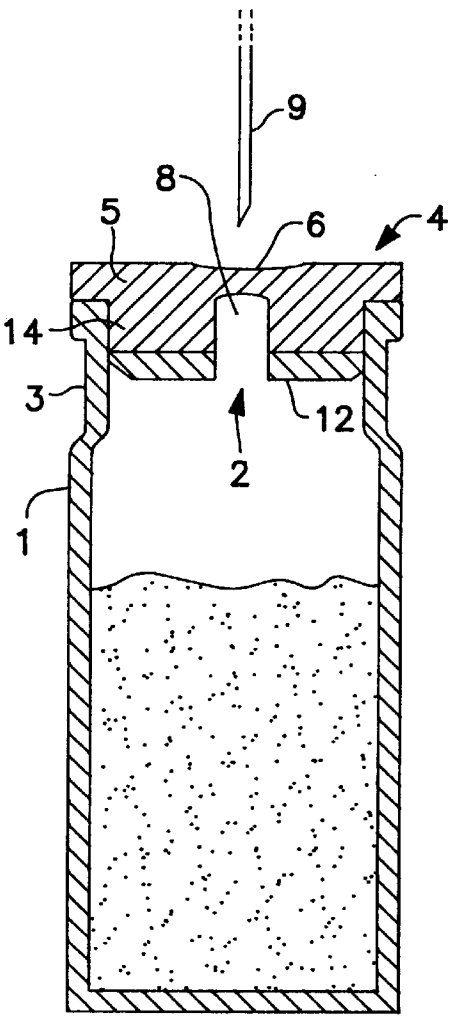
Figure 1:
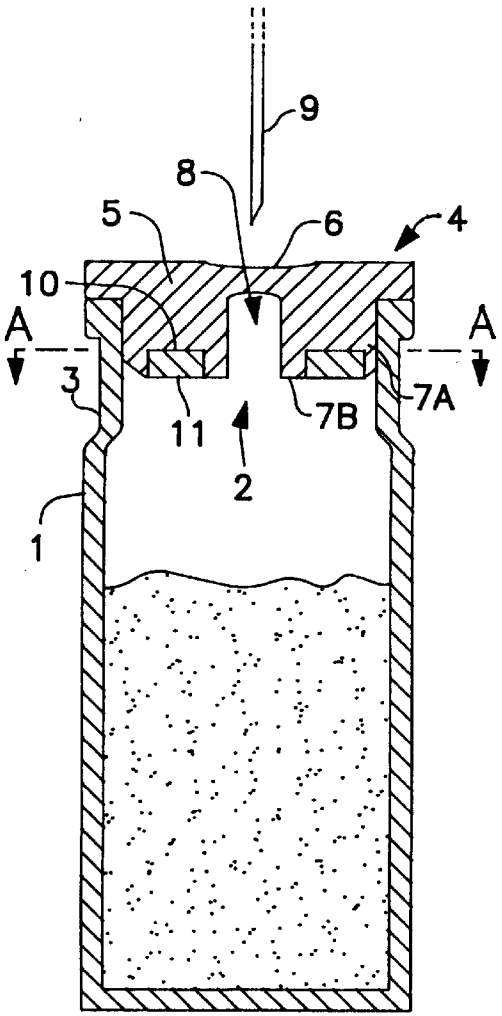

The invention will now be described by way of example only with reference to the accompanying drawings, which show:

FIGS. 1, 2 and 3: longitudinal sections through alternative multi-part construction vials and closures of the invention.

Figure 4:
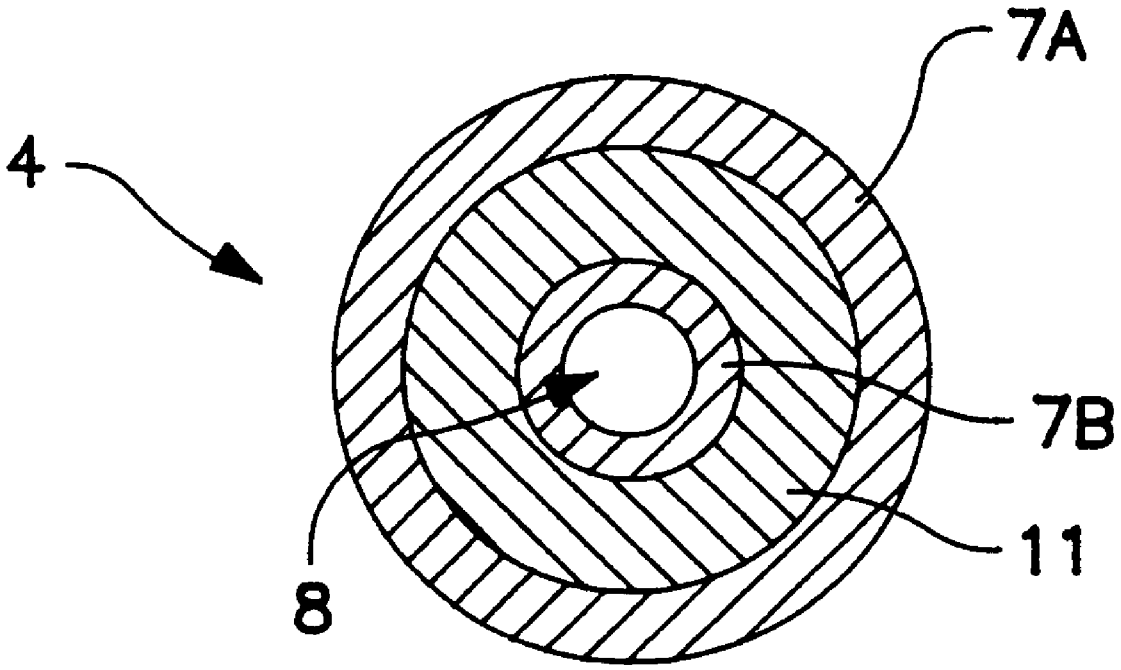
FIG. 4 shows a sectional view through the closure of FIG. 1 about the line A—A of FIG. 1 looking in the direction of the arrows.

FIG. 4: a sectional view through the closure of FIG. 1 about the line A—A of FIG. 1 looking in the direction of the arrows.

Figure 5:
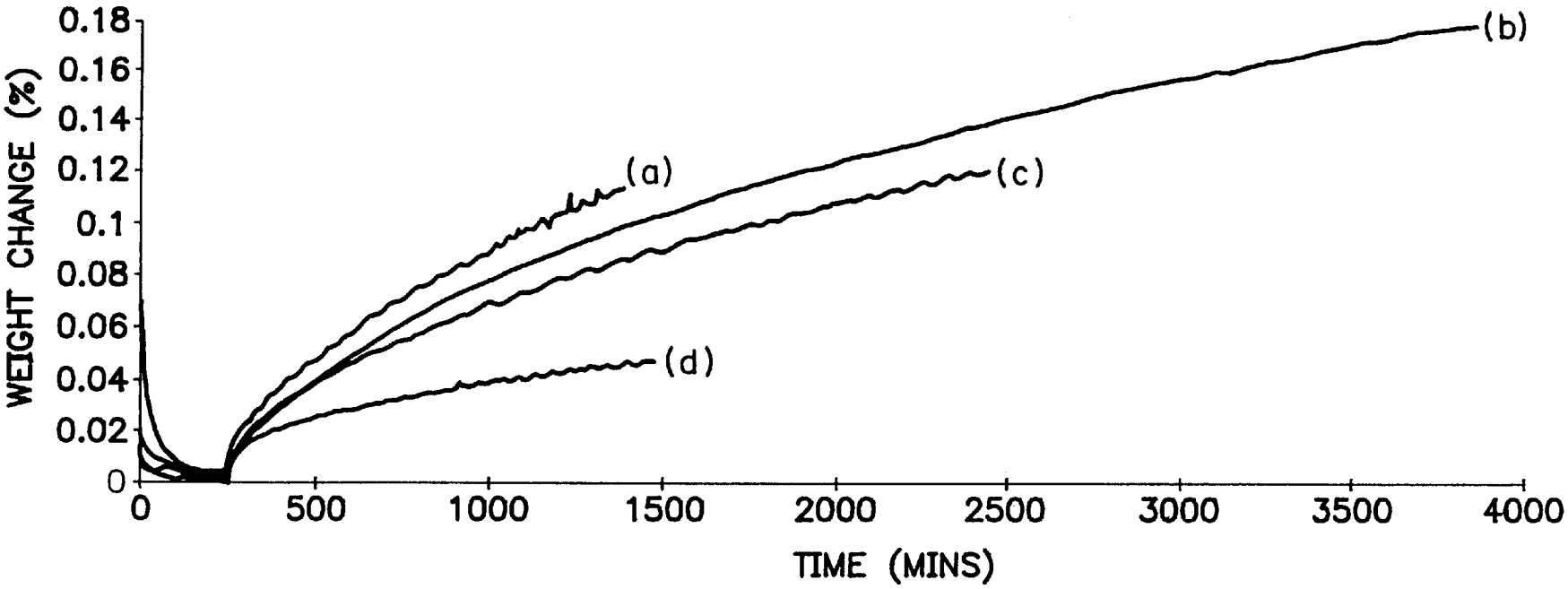
FIGS. 5 to 7 demonstrate in graphical format moisture uptake for rubbers compounded with various listed desiccants.
Figure 6:
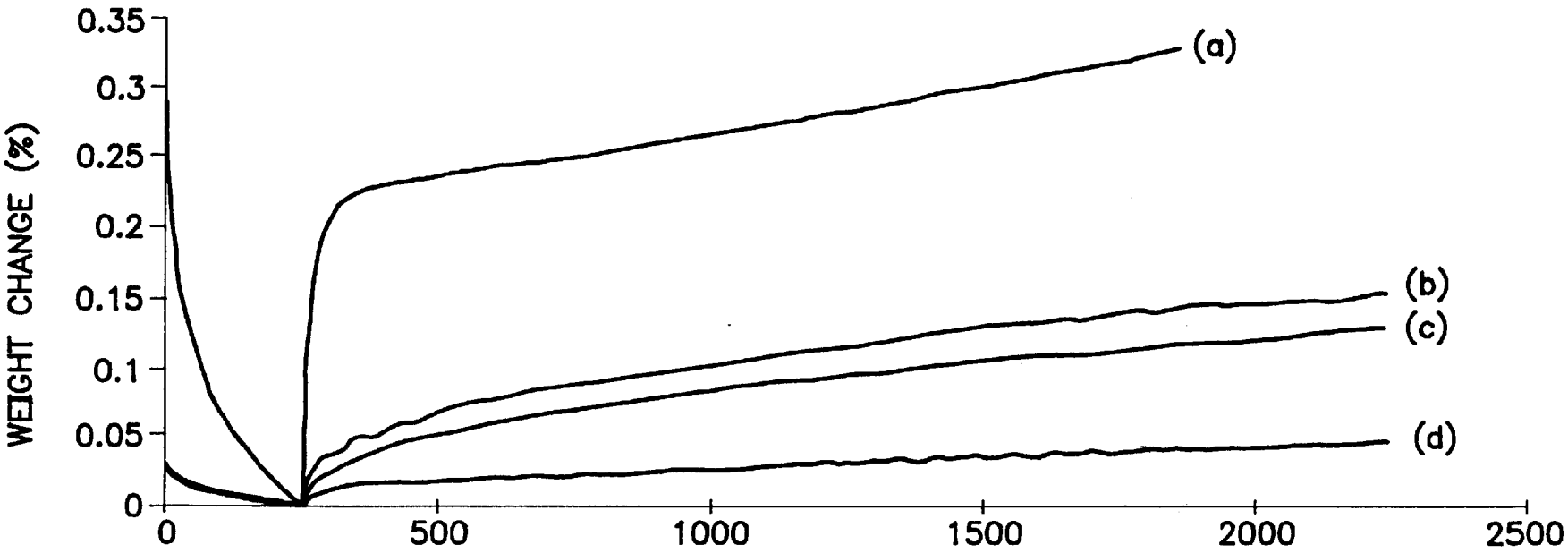
Figure 7:
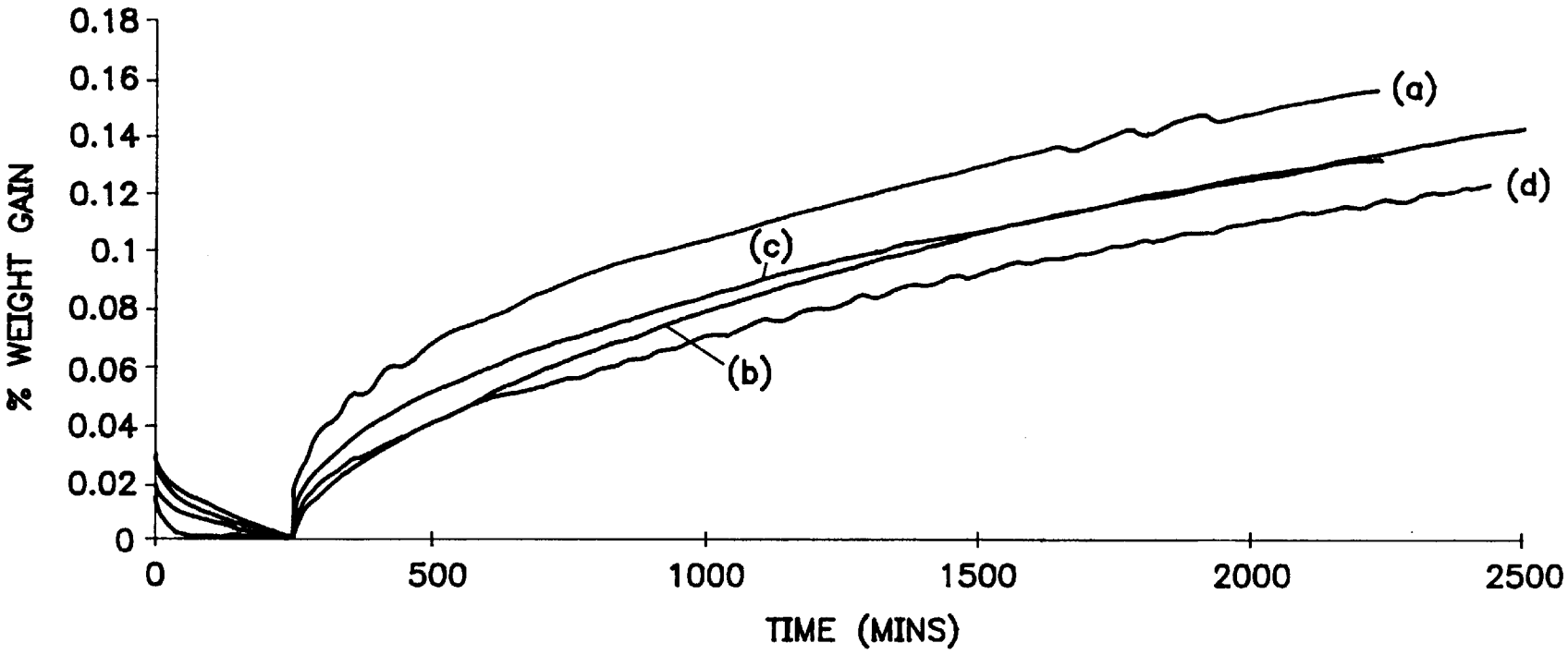

FIGS. 5–7: graphs showing moisture uptake for rubbers compounded with various listed desiccants.

Figure 8:
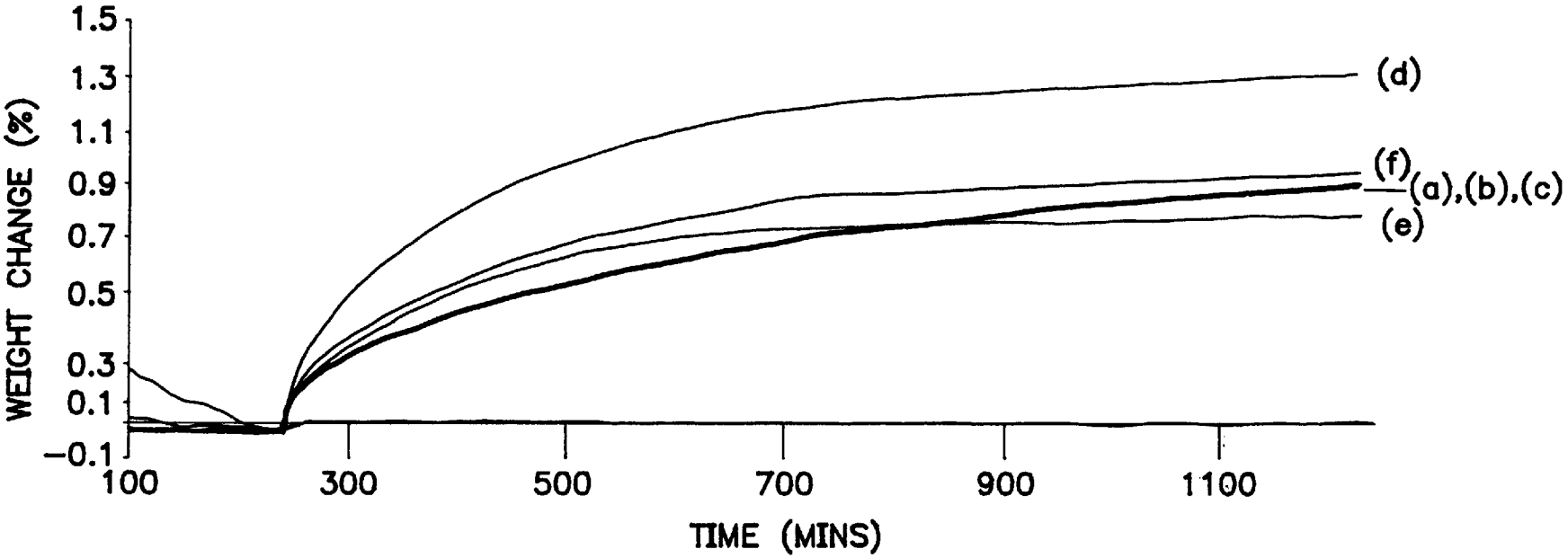
FIG. 8 demonstrates a graph of normalised moisture uptake for dried hydrogels (a) to (f) as tested in Example 4.

FIG. 8: a graph of normalised moisture uptake for dried hydrogels (a) to (f) tested in example 4.

Referring to FIGS. 1 to 4, a glass vial (1) has a mouth opening (2) defined by the rim of an inwardly extending neck (3). In the neck (3) of the vial (1) is a closure (4 generally) integrally made of a synthetic rubber material, and which comprises a closure wall (5) which sealingly engages the rim of the mouth opening (2). Centrally located in the closure wall (5) is a thinned puncturable region (6).

Referring specifically to FIG. 1, extending inwardly into the vial (1) from the closure wall (5) is an integral holder (7) in the form of two concentric walls (7A, 7B) the outer of which (7A) forms a neck plug which sealingly engages the neck (3) with a compression fit. The inner wall (7B) defines a central space (8) with the puncturable region (6) at its outer end. A hypodermic needle (9) may be inserted through the puncturable region (6) and passed along the passage into the vial defined by the space (8).

Between the inner and outer walls (7A, 7B) is a ring-shaped cavity (10) which contains a desiccant polymer (11) in the form of a ring with a central opening. The ring (11) is retained in place in the cavity (10) by the inherent resilience of the closure material.

Referring specifically to FIG. 2 an alternative construction of vial is shown. Parts having a common identity with FIG. 1 are correspondingly numbered. In the vial of FIG. 2 the desiccant polymer is in the form of a ring (12) which is bonded to the inner face (13) of the closure wall (5) where this extends inwardly into the interior of the vial (1) in the form of a neck plug (14), with its central opening in communication with the central space (8) of the closure. The neck plug (14) sealingly engages the neck (3) with a compression fit Referring to FIG. 3 an alternative construction of vial is shown. Parts having a common identity with FIG. 1 are correspondingly numbered. In the vial of FIG. 2 the desiccant polymer is in the form of a ring (15) with a central opening (16). The ring (15) fits into a central cavity (17) in the closure wall (5) where this extends inwardly into the interior of the vial (1) to form a neck plug (18) and is held there in place by the resilience of the material of the closure (4). The central opening (16) in the ring (15) defines a passage having the puncturable region (6) at its outer end. The neck plug (18) sealingly engages the neck (3) with a compression fit.

The closure wall (5) may be fastened tightly against the rim of the neck (3) by means of a circlip (not shown). In another embodiment (not shown) a holder for the desiccant polymer (11) may be made as a separate part in the form of two walls analogous in shape to walls (7A, 7B) with a cavity (10) and desiccant polymer (11) between them, and with a base wall.

It should be noted that if the desiccant polymer is a hydrogel polymer shrinkage may occur on drying which may affect the retention of the polymer on a rubber closure, and steps, e.g a suitable construction of holder, which will be apparent to those skilled in the art, might be necesary to overcome this.

In use, the hypodermic needle (9) is inserted through the puncturable region (6), and along the passage (8), into the vicinity of the contents (13) of the vial (1), a dry mixture of potassium clavulanate and anhydrous crystalline sodium amoxycillin. Sterile water is injected down the needle (9) to dissolve the contents (13), and the vial may be shaken to encourage dissolution. The solution may then be withdrawn through the needle (9) into a syringe (not shown) for subsequent use.

EXAMPLE 1

Rubbers Compounded with Desiccants

A closure for a glass vial of the type conventionally used for the containment made, using a standard known compounded halobutyl rubber formulation, but in which 50% by weight of the conventional china clay filler was replaced with calcium oxide ground to a particle size distribution similar to that of the filler. The shape and size of the closure corresponded to those of a conventional vial closure. The volume of the vial was ca. 10 ml. The molecular sieve was dried using a standard process for drying the molecular sieve.

A moisture sensitive pharmaceutical formulation, being 500 mg crystalline sodium amoxycillin prepared as described in EP 0131147 coformulated with 100 mg of potassium clavulanate was filled into the vial under conditions of less than 30% RH and the vial was sealed with the stopper as conventional, with the stopper being retained on the vial using a conventional thin metal cover.

The vial containing the formulation was stored under ambient and accelerated storage conditions. Colour measurements (a known sensitive method of assessing the degree of decomposition of potassium clavulanate) showed a degree of protection of the potassium clavulanate effectively equivalent to that shown using spray-dried sodium amoxycillin having desiccant properties, in a conventionally stoppered vial.

A similar result was achieved when calcium oxide instead of molecular sieve was compounded with the rubber, and when all of the filler was replaced by these desiccants.

EXAMPLE 2

Rubbers Compounded with Desiccants

In a further experiment potassium clavulanate was enclosed within an airtight glass vessel, and a piece of halobutyl rubber compounded with calcium oxide as mentioned above in Example 1 was suspended inside the vial on a piece of wire. A control experiment was set up consisting of an identical vessel enclosing the same weight of potassium clavulanate but without the compounded rubber. The decomposition of the potassium clavulanate under the action of traces of moisture in the atmosphere of the vial and in the potassium clavulanate itself, or adsorbed on the inner surface of the vial was monitored. Colour measurements showed that decomposition of the potassium clavulanate was significantly retarded in the vessel containing the rubber compounded with the desiccant.

EXAMPLE 3

Rubbers Compounded with Desiccants.

FIG. 5 shows the moisture uptake (normalised data) in terms of weight % at ca. 10% RH by desiccant polymers which are halobutyl rubbers of standard formulation except that 20–40% of the china clay filler normally used has been replaced by the desiccant indicated. Grace A3™, Siliporite™ and Ferben 200™ are commercially available powdered desiccants, sold under these trade names, and were pre-dried according to the standard procedures for these desiccants. Grace A3™ and Siliporite™ are types of molecular sieve powder obtainable from W R Grace Ltd. Northdale House, North Circular Road, London NW10 7UH, GB. The graph relates to the desiccant fillers:

(a) Siliporite™
(b) molecular sieve
(c) Grace A3™
(d) Ferben 200™

FIG. 6 shows the moisture uptake (normalised data) in terms of weight % at ca. 10% RH by desiccant polymers which are halobutyl rubbers of standard formulation except that 20–40% of the china clay filler normally used has been replaced by the desiccant, after the rubber has been tote washed. The graph relates to the desiccant fillers:

(a) calcium oxide
(b) molecular sieve
(c) Grace A3™
(d) Siliporite™

FIG. 7 shows the moisture uptake (normalised data) in terms of weight % at ca. 10% RH by desiccant polymers which are halobutyl rubbers of standard formulation that 20–40% of the china clay filler normally used has been replaced by the desiccant indicated, before and after the rubber has been tote washed. The graph relates to the desiccant fillers:

(a) molecular sieve—washed
(b) molecular sieve—unwashed
(c) Grace A3™—washed
(d) Grace A3™—unwashed The data presented in these graphs show that rubber compounded with these desiccants has a desiccant ability even at RH as low as 10% RH, and this desiccant ability is relatively unaffected by washing.

EXAMPLE 4

Hydrophilic Hydrogels

Samples (a)–(f) of known hydrogels as tabulated below were obtained in a hydrated state and were activated by heating to ca. 120° C. under vacuum for a minimum of 3 hours.

(a) 90:10 hydroxyethyl methacrylate:N,N-dimethylacrylamide copolymer
(b) 90:10 hydroxyethyl methacrylate:N-vinyl pyrrolidone copolymer
(c) 90:10 hydroxyethyl methacrylate:acryloyl morpholine copolymer
(d) 70:30 N-vinyl pyrrolidone:methyl methacrylate copolymer
(e) 30:70 methyl methacrylate:acryloyl morpholine copolymer
(f) 50:50 hydroxy methacrylate:acryloyl morpholine copolymer The moisture uptake of all six samples was evaluated in a standardised 24 hour cycle on the Dynamic Vapour Sorption apparatus. The samples were prepared and placed at a nominal 0% RH (actual 2%) for 4 hours to complete activation. The RH was then raised to a nominal 10% (actual 12%) for 1000 minutes and then returned to 0% for a further 200 minutes completing the 24 hour cycle. Data was normalised to allow for any weight loss during the 4 hour activation stage, and is illustrated in FIG. 8.

In order to evaluate whether the samples had reached a stable equilibrium at the end of the holding time at 10% RH two samples (c) and (d) with different profiles in the screening test above were selected and held for 24 hours at 0% RH followed by ca. 45 hours at 10% RH. This confirmed that maximum moisture uptake was achieved within 1000 minutes.

It was clear from these results that all hydrogels tested had highly significant water uptake at low RH, i.e. 10%. The majority of the water uptake occurred extremely rapidly and final equilibrium was attained within 17 hours or less. The maximum uptake using hydrogel polymers was for sample (d) which was able to absorb approximately 1.7% of its own weight of water at 10% RH when fully dried.

The hydrogel samples showed the physical changes listed below during the test:

(a) very brittle when dried
(b) least brittle when dried
(c) very brittle when dried
(d) considerable shrinkage on drying
(e) opaque when dried.

We claim:

1. A container having within it contents comprising a moisture sensitive material and an atmosphere, the container comprising a container body of a substantially atmospheric moisture-impermeable material and having an opening sealed by a closure, the closure having an inner face exposed to said contents, at least a part of said closure being made of a desiccating polymer and forming at least a part of said inner face, the desiccatitng polymer being an elastomeric material compounded with a filler, the elastoneric material further including a sufficient quantity of a desiccating material to absorb enough moisture from said contents of the container to reduce degradation of the moisture sensitive material by water and water vapour, the closure also comprising a closure wall having a puncturable region therein in direct communication with the interior of the container.

2. A container according to claim 1 which is a vial.

3. A container according to claim 2 which vial is glass.

4. A container according to claim 3 which vial contains potassium clavulanate and sodium amoxycillin.

5. A container according to claim 4 wherein the desiccating polymer is able to take up atmospheric moisture at 30% RH or less.

6. A container according to claim 4 wherein the sodium amoxycillin is crystalline sodium amoxycillin.

7. A container according to claim 1 in which the elastomeric material is selected from the group consisting of a halobutyl and silicone rubber.

8. A container according to claim 7 wherein the elastomeric material further contains a reinforcing filler, and wherein the desiccating material replaces from about 10 to about 50% of the weight of the filler.

9. A container according to claim 8 wherein the desiccating material replaces from about 20 to about about 40% of the filler.

10. A container according to claim 8 wherein the desiccating material replaces from about 40 to about 50% of the filler.

11. A container according to claim 1 in which the desiccating material is an inorganic desiccating material.

12. A container according to claim 11 in which the desiccating material chemically absorbs water.

13. A container according to claim 11 in which the desiccating material chemically fixes water.

14. A container according to claim 11 in which the desiccating material physiochemically absorbs water.

15. A container according to claim 11 in which the desiccating material is selected from the group consisting of a dried molecular sieve, calcium oxide, and mixtures thereof.

16. A container according to claim 11 or 15 in which the elastomeric material is chlorobutyl rubber.

17. A container according to claim 1 in which the desiccating polymer is able to take up atmospheric moisture at 30% RH or less.

18. A container according to claim 1 in which part of the closure which engages the opening is at least partly made of an elastomeric material thereby allowing a tight compression fit with the mouth of the container.

19. A container according to claim 1 in which the closure is of multi-part construction.

20. A container according to claim 1 wherein the closure is made only of the desiccating polymer.

21. A container according to claim 1 in which the quantity of desiccating material in the desiccating polymer is sufficient to prevent degradation of the moisture senstitive material by water and water vapor.

22. A container according to claim 1 in which said desiccating polymer forms a part of the closure and is exposed only to the interior of the closure.

23. A container according to claim 1 in which said desiccating polymer forms a part of the closure and is separated from the external atmosphere by a part of the closure which does not include desiccating polymer.

24. A container according to claim 1 in which said desiccating polymer constitutes from about 10% to about 50% of the weight of the filler.

25. A container for a moisture sensitive material in the form of a vial, having a container body of glass and having an opening sealed by a closure which closure is wholly made of halobutyl rubber compounded with a filler and a desiccating material selected from the group consisting of molecular sieve, calcium oxide, and mixtures thereof, and wherein the desiccating material replaces from about 10 to 50% of the weight of the filler, the closure comprising a closure wall having a puncturable region therein in direct communication with the interior of the container.

26. A container according to claim 25 wherein the desiccating material replaces from about 40 to about 50% of the filler.

27. A method of desiccating potassium clavulanate in combination with crystalline sodium amoxycillin which comprises enclosing potassium clavulanate in combination with crystalline sodium amoxycillin in a container with a closure, the closure comprising a dessicatintg polymer and maintaining the desiccating polymer in contact with the atmosphere inside said container, the desiccating polymner being an elastomeric material compounded with a desiccating material which material provides the dessicating activity in said container.

28. A method of desiccating lyophilised, freeze dried material which comprises, as a final dehydrating step, placing the material in a container as defined in claim 1, in the form of a vial, and having a closure made of a desiccating polymer formed from an elastomeric material compounded with a desiccating material, sealing said vial, so that the dehydration process is completed in the sealed vial.

29. A closure for a vial, containing a mouth opening, which closure is formed from an elastomeric material compounded with a filler and a desiccating material, and wherein the desiccating material replaces from about 10 to 50% of the weight of the filler, the closure comprising a closure wall having a puncturable region therein in direct communication with the interior of the vial.

30. A closure according to claim 29 in which the elastomeric material is selected from the group consisting of halobutyl and silicone rubber.

31. A closure according to claim 29 in which the desiccating material is an inorganic desiccating material.

32. A closure according to claim 31 in which the desiccating material chemically absorbs water.

33. A closure according to claim 31 in which the desiccating material chemically fixes water.

34. A closure according to claim 31 in which the desiccating material physiochemically absorbs water.

35. A closure according to claim 31 in which the desiccating material is selected from the group consisting of a dried molecular sieve, calcium oxide, and mixtures thereof.

36. A closure according to claim 30 or 35 in which the elastomeric material is chlorobutyl rubber.

37. A closure according to claim 29 in which part of the closure which engages the mouth opening is at least partly made of an elastomeric material thereby allowing a tight compression fit with the mouth opening of the container.

38. A closure according to claim 29 which is of multi-part construction.

39. A closure according to claim 37 or 38 in which the closure is made wholly of the desiccating polymer.

40. A closure according to claim 29 wherein the desiccating material replaces from about 40 to about 50% of the filler.

41. A closure according to claim 29 in which the elastomeric material is a halobutyl rubber.

42. A closure according to claim 29 in which the desiccating material is selected from the group consisting of molecular sieve, calcium oxide, and mixtures thereof.

43. A closure according to claim 29 in which the filler comprises a china clay.

* * * * *